US010654605B2

(12) United States Patent
Takahashi et al.

(10) Patent No.: US 10,654,605 B2
(45) Date of Patent: May 19, 2020

(54) PACKING APPARATUS

(71) Applicant: ISHIDA CO., LTD., Kyoto-shi, Kyoto (JP)

(72) Inventors: Atsushi Takahashi, Ritto (JP); Yuji Yokota, Ritto (JP); Yoshinobu Shimomae, Ritto (JP); Tomoko Kobayashi, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 231 days.

(21) Appl. No.: 15/541,519

(22) PCT Filed: Oct. 14, 2015

(86) PCT No.: PCT/JP2015/078991
§ 371 (c)(1),
(2) Date: Jul. 5, 2017

(87) PCT Pub. No.: WO2016/117184
PCT Pub. Date: Jul. 28, 2016

(65) Prior Publication Data

US 2018/0022492 A1 Jan. 25, 2018

(30) Foreign Application Priority Data

Jan. 23, 2015 (JP) ..... 2015-011254

(51) Int. Cl.
*B65B 51/06* (2006.01)
*B65B 57/02* (2006.01)
(Continued)

(52) U.S. Cl.
CPC ..... *B65B 51/067* (2013.01); *B65B 7/16* (2013.01); *B65B 7/20* (2013.01); *B65B 51/06* (2013.01); *B65B 57/02* (2013.01); *B65B 57/00* (2013.01)

(58) Field of Classification Search
None
See application file for complete search history.

(56) References Cited

U.S. PATENT DOCUMENTS 3,775,937 A * 12/1973 Devan ..... B65B 7/20 53/136.4
3,916,599 A * 11/1975 Mae ..... B65B 57/14 100/14
(Continued)

FOREIGN PATENT DOCUMENTS

JP 05-112334 A 5/1993
JP 2002-020027 A 1/2002
(Continued)

OTHER PUBLICATIONS

Machine Translation of JP 2004276951 A, Kunihiro, from Espacenet.com (Year: 2004).*
(Continued)

*Primary Examiner* — Robert F Long
*Assistant Examiner* — Xavier A Madison
(74) *Attorney, Agent, or Firm* — Global IP Counselors, LLP

(57) ABSTRACT

A packing apparatus includes a sealing mechanism, a timing sensing section, and a control section. The sealing mechanism affixes tape continuously on portions of a cardboard box transported with major flaps thereof folded. The sealing mechanism includes an affixing roller to press the tape against a first side surface and the major flaps. The timing sensing section senses the timing at which the affixing of the tape on the first side surface is initiated. The control section controls pressing force exerted by the affixing roller, based on a result of the sensing performed by the timing sensing section, in such a way that the pressing force is reduced after the affixing of the tape on the first side surface is initiated.

10 Claims, 11 Drawing Sheets

(51) Int. Cl.

| | |
|---|---|
| ***B65B 7/20*** | (2006.01) |
| ***B65B 7/16*** | (2006.01) |
| *B65B 57/00* | (2006.01) |

(56) References Cited

U.S. PATENT DOCUMENTS

| | | | | |
|---|---|---|---|---|
| 4,506,488 | A * | 3/1985 | Matt | B65B 57/00 53/450 |
| 4,538,398 | A * | 9/1985 | Marchetti | B65B 51/067 100/7 |
| 5,347,791 | A * | 9/1994 | Ginzl | B65B 9/067 53/450 |
| 7,937,905 | B2 | 5/2011 | Fox et al. | |
| 2007/0107825 | A1* | 5/2007 | Bredl | B65B 51/067 156/64 |
| 2008/0099975 | A1* | 5/2008 | Iguchi | B65H 29/46 270/58.28 |
| 2010/0175836 | A1 | 7/2010 | Lam | |
| 2012/0102893 | A1* | 5/2012 | Sambuca, Jr. | B65B 51/067 53/476 |
| 2014/0094354 | A1* | 4/2014 | Lam | B65H 26/02 493/37 |

FOREIGN PATENT DOCUMENTS

| | | | |
|---|---|---|---|
| JP | 2004-276951 | A | 10/2004 |
| JP | 2004276951 | A * | 10/2004 |
| JP | 2009-515793 | A | 4/2009 |
| JP | 2010-006385 | A | 1/2010 |
| JP | 2012-515119 | A | 7/2012 |
| KR | 10-0824032 | B1 | 4/2008 |

OTHER PUBLICATIONS

Translation of the Written Opinion of the International Searching Authority, dated Aug. 3, 2017.

* cited by examiner

PACKING APPARATUS

CROSS-REFERENCE TO RELATED APPLICATIONS

This U.S. National stage application of PCT/JP2015/078991 claims priority under 35 U.S.C. § 119(a) to Japanese Patent Application No. 2015-011254, filed in Japan on Jan. 23, 2015, the entire contents of which are hereby incorporated herein by reference.

TECHNICAL FIELD

The present invention relates to a packing apparatus, and particularly to a packing apparatus including a sealing mechanism to seal the lid of a cardboard box with a tape while being transported.

BACKGROUND ART

Packing apparatuses including a sealing mechanism to affix a tape on a cardboard box, which is transported in a state where flaps are folded in and closed, to seal the lid of the cardboard box are known in the art, as disclosed in Japanese Patent Laid-Open No. 2002-20027.

The sealing mechanism disclosed in Japanese Patent Laid-Open No. 2002-20027 first affixes a tape on a side surface of the cardboard box that is arranged on the downstream side with respect to the transportation direction, then affixes the tape on the folded-in flaps that form the lid of the cardboard box, and finally affixes the tape on a side surface that is arranged on the upstream side with respect to the transportation direction. When the sealing mechanism affixes the tape on the cardboard box, a pressing member of the sealing mechanism exerts, on the cardboard box, pressing force that presses the tape against the cardboard box so that the tape is caused to be in intimate contact with the cardboard box.

SUMMARY OF THE INVENTION

Technical Problem

A cardboard box has relatively low strength in some cases depending on the nature thereof (e.g., in a case where the cardboard box is relatively thin or in a case where the cardboard box is reused).

In such cases, the inventor of the present application has found that the sealing mechanism disclosed in Japanese Patent Laid-Open No. 2002-20027 may, when the pressing member exerts the pressing force on the cardboard box to affix the tape, can deform and even damage the cardboard box. The inventor of the present application has further found that in a case where the magnitude of the pressing force exerted by the pressing member on the cardboard box is reduced to prevent deformation or damage of the cardboard box or any other problem therewith, the tape may not be successfully affixed on the cardboard box when the tape is firstly affixed on the side surface on the downstream side with respect to the transportation direction, and sealing errors, which are a circumstance in which the tape fails to be affixed on the cardboard box, may be caused.

An object of the invention is to provide a packing apparatus having a sealing mechanism sealing a lid of a transported cardboard box with a tape, that is unlikely to produce sealing errors, where the tape fails to be affixed on the cardboard box, and can prevent deformation of the cardboard box or any other problem therewith.

Solution to Problem

A packing apparatus according to a first aspect of the invention includes a sealing mechanism, a timing sensing section, and a pressing force control section. The sealing mechanism affixes a tape continuously on the following portions of a cardboard box transported in a state that flaps thereof are folded in and closed: a first side surface on a downstream side with respect to a transportation direction; the folded-in flaps; and a second side surface facing the first side surface, and seals a lid of the cardboard box. The sealing mechanism includes a pressing member to press the tape against the first side surface and the flap. The timing sensing section senses a timing at which the affixing of the tape on the first side surface is initiated. The pressing force control section controls pressing force exerted by the pressing member, based on a result of the sensing performed by the timing sensing section, in such a way that the pressing force is reduced after the affixing of the tape on the first side surface is initiated.

In the packing apparatus according to the first aspect of the invention, after the affixing of the tape on the first side surface is initiated, the pressing force exerted by the pressing member, which presses the tape against the first side surface and the flap, is controlled to be reduced in the sealing mechanism. The packing apparatus according to the first aspect of the invention can therefore suppress the incidence of sealing errors, in which the tape fails to be affixed on the first side surface of the cardboard box, and can prevent deformation of the cardboard box or any other problem therewith due to the pressing force.

A packing apparatus according to a second aspect of the invention is the packing apparatus according to the first aspect in which the sealing mechanism further includes an elastic member and an actuator. The elastic member exerts elastic force on the pressing member to cause the pressing member to produce the pressing force. The actuator acts on the pressing member in such a way that the pressing force exerted by the pressing member is reduced. The pressing force control section controls the pressing force of the pressing member, which the elastic member causes to produce, to be reduced by operating the actuator.

In the packing apparatus according to the second aspect of the invention, the incidence of sealing errors, in which the tape fails to be affixed on the first side surface, can be reduced, and deformation of the cardboard box or any other problem therewith due to the pressing force can be avoided by using a relatively simple configuration.

A packing apparatus according to a third aspect of the invention is the packing apparatus according to the first or second aspect in which the timing sensing section includes a sensor to detect that the cardboard box comes into contact with the pressing member.

In the packing apparatus according to the third aspect of the invention, since the timing, at which affixation of the tape on the first side surface is initiated, is sensed by detecting that the cardboard box comes into contact with the pressing member, it is easy for the timing at which affixation of the tape is initiated to be accurately ascertained.

A packing apparatus according to a fourth aspect of the invention is the packing apparatus according to the first or second aspect in which the timing sensing section includes a photoelectric sensor to detect whether or not the transported cardboard box is present.

In the packing apparatus according to the fourth aspect of the invention, a relatively simple configuration using the photoelectric sensor allows sensing of the timing at which affixation of the tape on the first side surface is initiated.

A packing apparatus according to a fifth aspect of the invention is the packing apparatus according to the first or second aspect in which the timing sensing section senses the timing at which the affixing of the tape on the first side surface is initiated based on a time for which the cardboard box is transported from a predetermined position.

In the packing apparatus according to the fifth aspect of the invention, the timing, at which affixation of the tape on the first side surface is initiated, can be sensed without additionally providing a sensor.

A packing apparatus according to a sixth aspect of the invention is the packing apparatus according to any of the first to fifth aspects and further includes a guide. The guide comes into contact with the flap and a side surface of the cardboard box that is adjacent to the first side surface when the sealing mechanism affixes the tape.

In the packing apparatus according to the sixth aspect of the invention, since the guide, which comes into contact with the flap and the side surface adjacent to the first side surface, is provided, deformation of the cardboard box can be readily avoided when the pressing member exerts the pressing force on the first side surface and the flap.

Advantageous Effects of Invention

The packing apparatus according to the invention can suppress the incidence of sealing errors, in which the tape fails to be affixed on the first side surface of the cardboard box, and can prevent deformation of the cardboard box or any other problem therewith due to the pressing force exerted by the pressing member.

BRIEF DESCRIPTION OF THE DRAWINGS

FIG. 2A is a schematic perspective view of a cardboard box used in the packing apparatus in FIG. 1 and shows the cardboard box in which the bottom lid is sealed and upper-lid-side flaps are not folded in.

DESCRIPTION OF EMBODIMENTS

A packing apparatus 10 according to an embodiment of the invention will be described with reference to the drawings. The following embodiment is a specific example of the invention and is not intended to limit the technical scope of the invention.

Figure 6A:
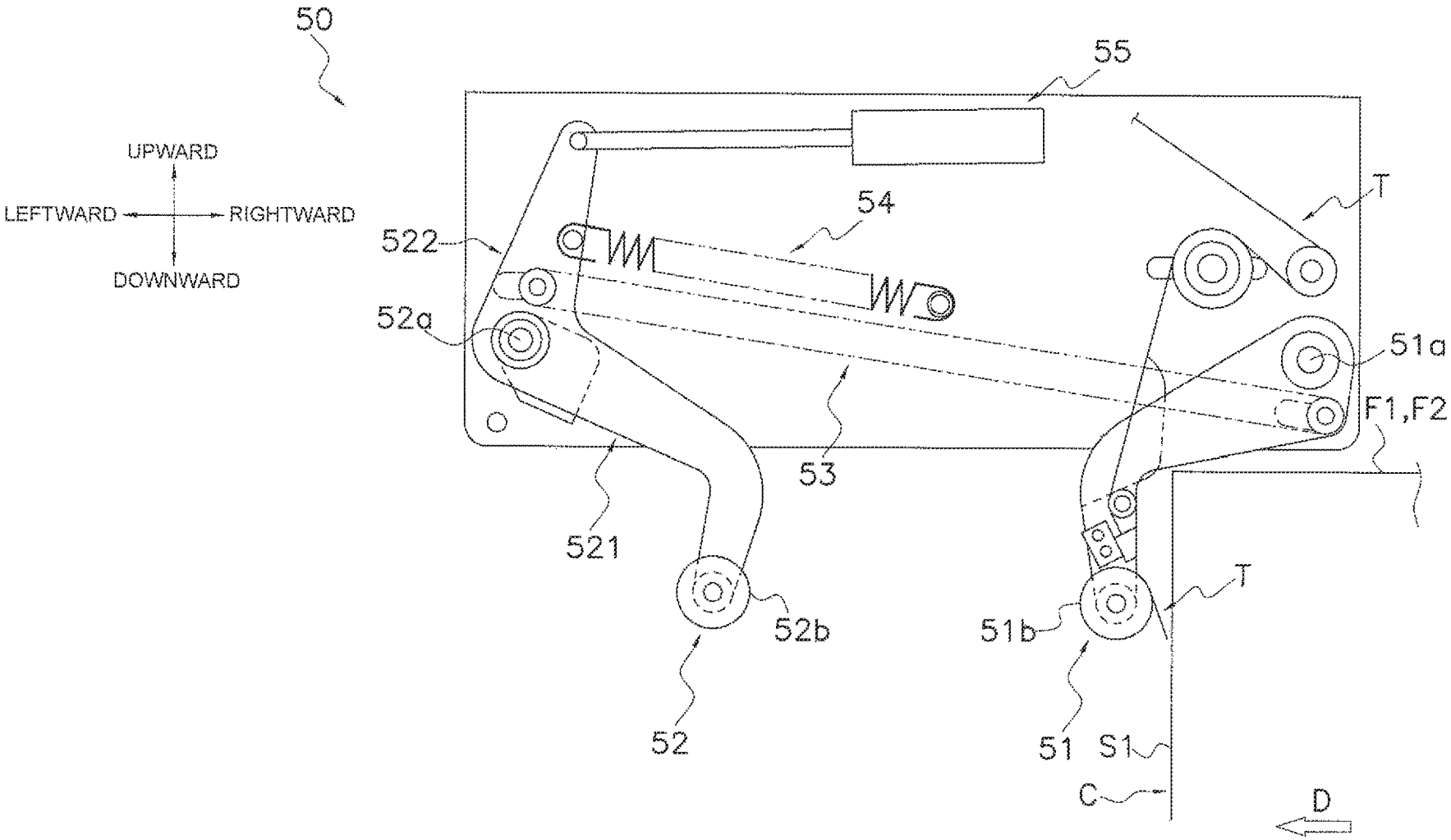
FIG. 6A is a schematic front view of the interior of the sealing mechanism in the box closing unit of the packing apparatus in FIG. 1 and shows the sealing mechanism before affixation of the tape on the cardboard box is initiated.
Figure 6B:
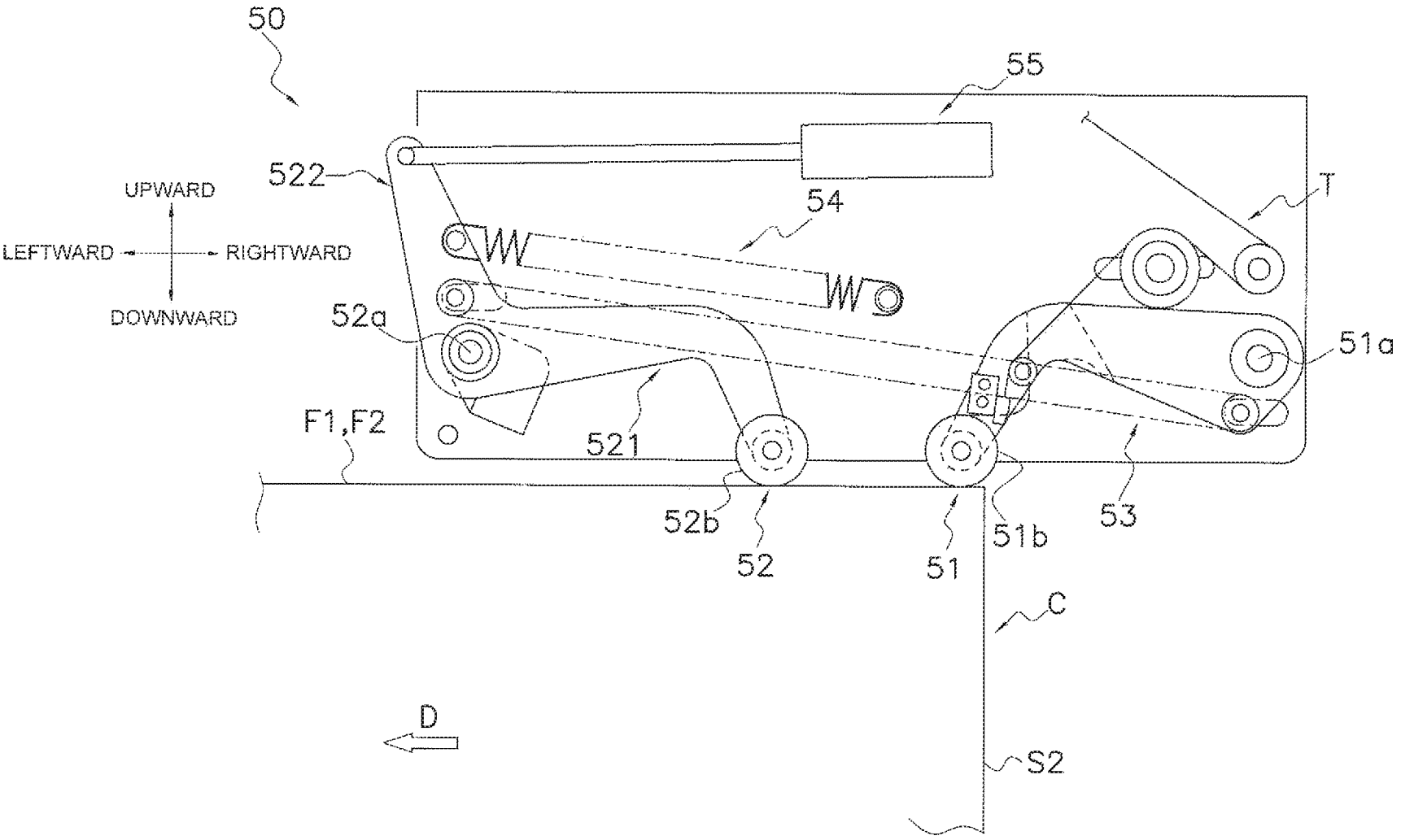
FIG. 6B is a schematic front view of the interior of the sealing mechanism in the box closing unit of the packing apparatus in FIG. 1 and shows a state in which a pressing roller of the sealing mechanism pushes major flaps of the cardboard box downward to affix the tape.
Figure 6C:
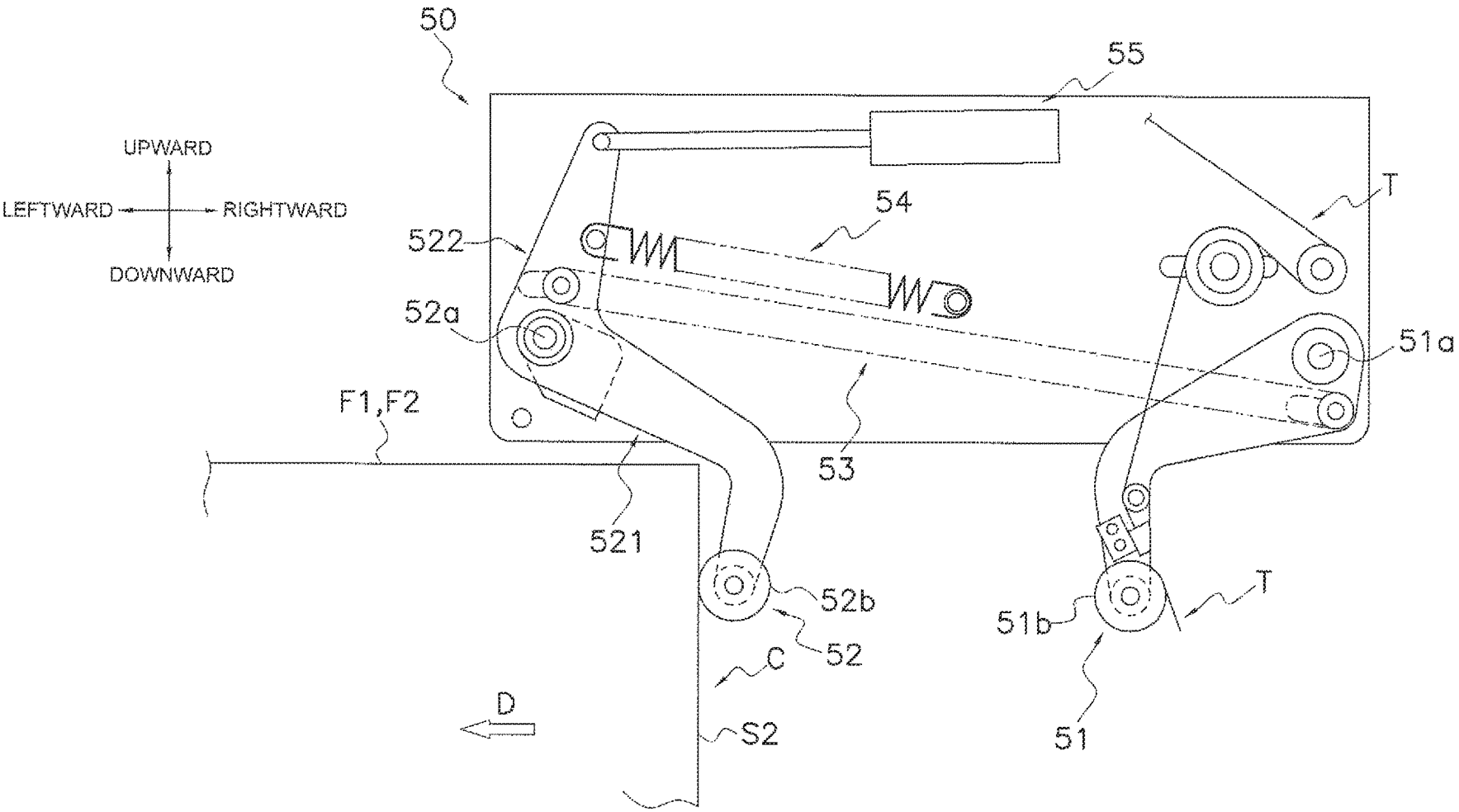
FIG. 6C is a schematic front view of the interior of the sealing mechanism in the box closing unit of the packing apparatus in FIG. 1 and shows the sealing mechanism immediately after affixation of the tape on the cardboard box is completed.
Figure 7:
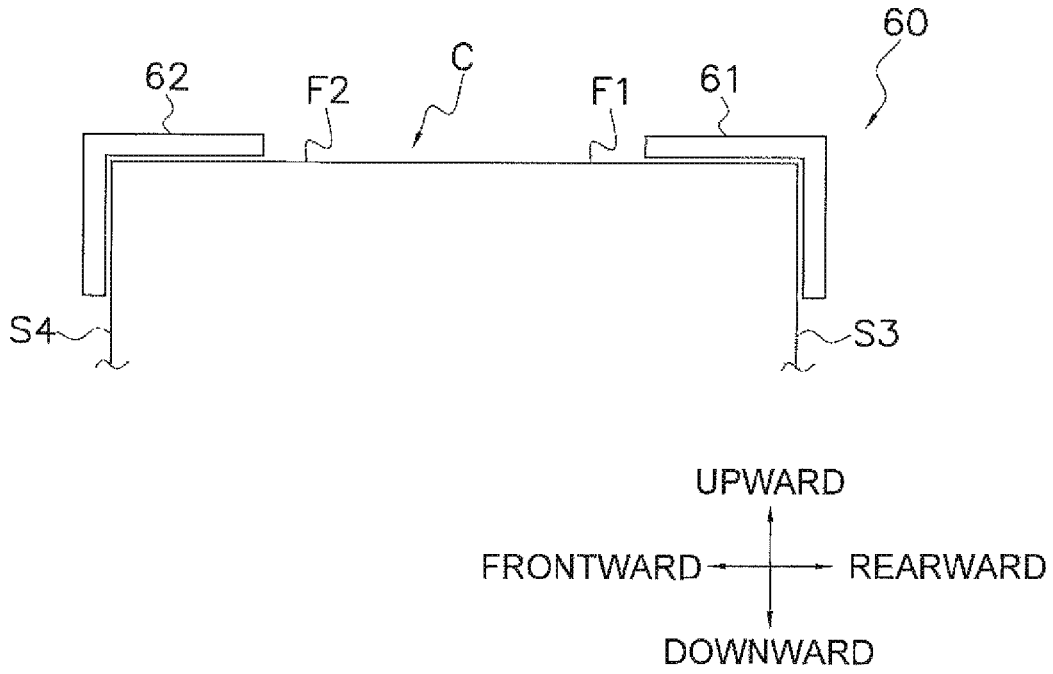
FIG. 7 is a schematic side view of a guide in the box closing unit of the packing apparatus in FIG. 1 viewed from the upstream side in the direction in which the cardboard box is transported.

In the following description, upward, downward, rightward, leftward, frontward (front side), rearward (rear side), and other terms are used in some cases to describe a direction and a position. These expressions are used in accordance with upward, downward, rightward, leftward, frontward, and rearward arrows shown in the drawings indicating a corresponding direction unless otherwise specified. Specifically, each drawing having arrows and corresponding identification of upward, downward, rightward, leftward, frontward and rearward directions correspond to the same identified direction all such marked drawings. In other words, the leftward side of the packing apparatus 10 shown in FIGS. 1 and 4, corresponds to a leftward side of the depicted portion(s) of the packing apparatus 10 shown in FIGS. 6A, 6B and 6C. Similarly, the leftward side of the box B shown FIGS. 2A and 2B is also the leftward side of the box B shown in FIGS. 1, 4, 6B and 6C. FIGS. 1, 4, 6A, 6B and 6C, are two dimensional (planar) frontward views where the rearward side of the depicted elements are not visible. FIG. 7 is a view looking from the rightward direction such that a leftward side (the first side surface S1) of the box B is not visible. Further, in the following description, parallel, perpendicular, vertical, horizontal, and the like are used in some cases to describe a direction, a positional relationship, and the like. It is noted in the description that the terms not only apply to exact parallelism, perpendicularity, verticality, horizontality, and the like but also substantial parallelism, perpendicularity, verticality, horizontality, and the like.

(1) Overview

The packing apparatus 10 will be schematically described.

Figure 1:
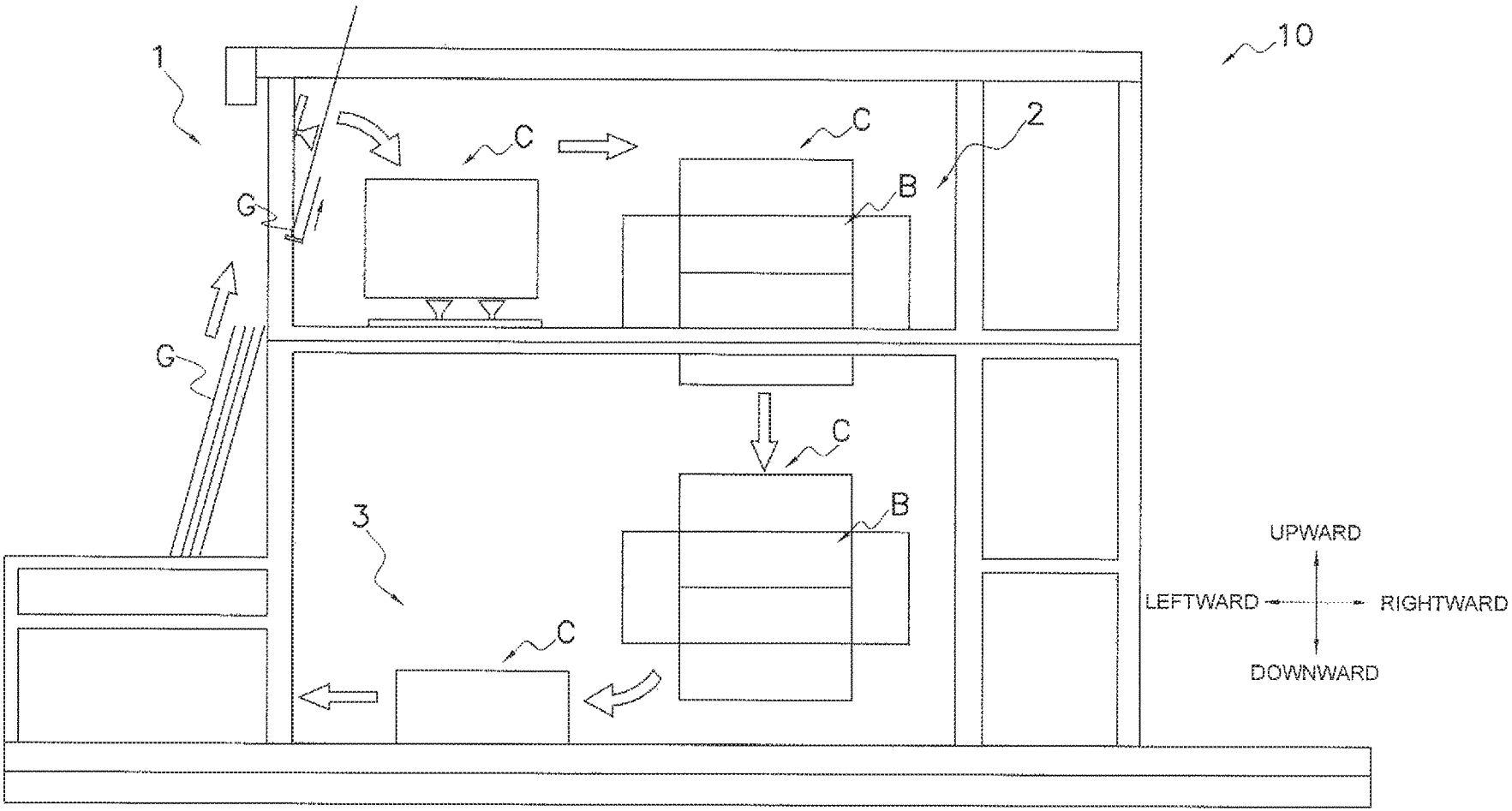
FIG. 1 is a schematic front view of a packing apparatus according to an embodiment of the invention.
Figure 2A:
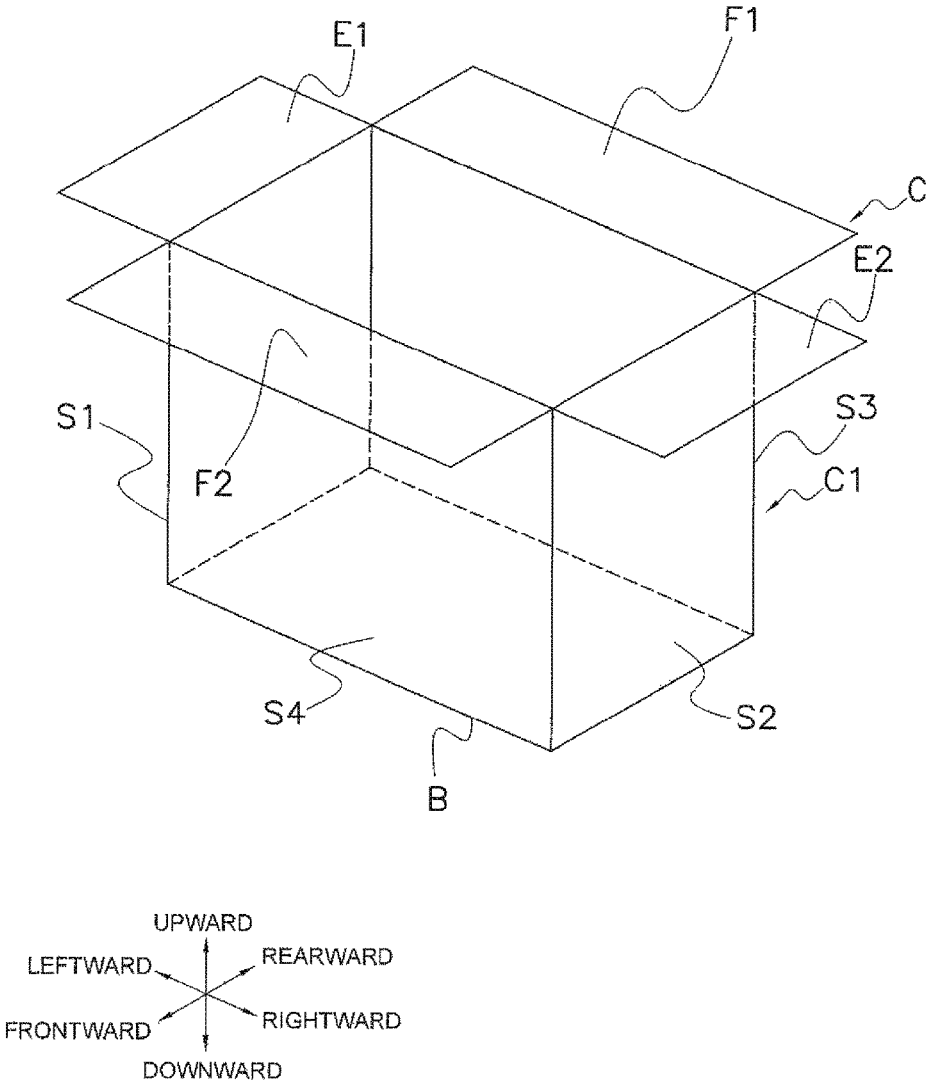
Figure 2B:
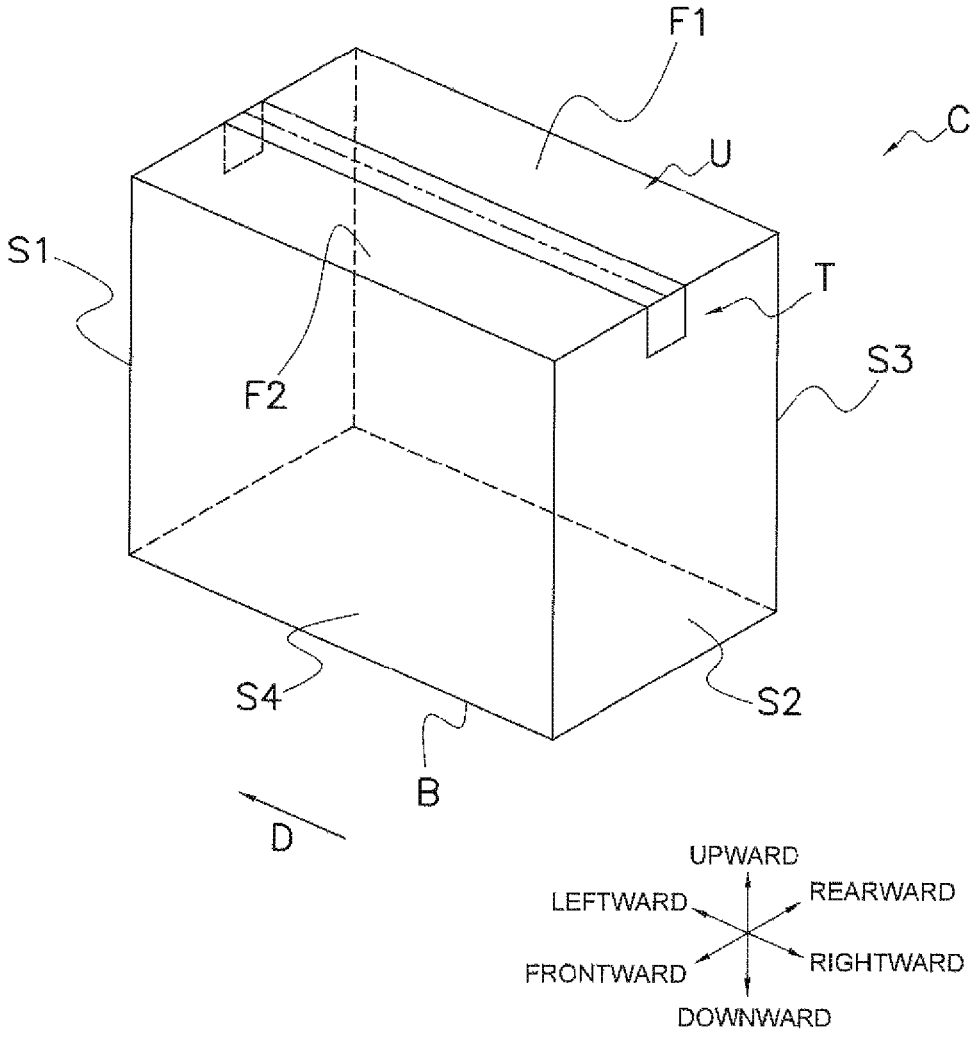
FIG. 2B is a schematic perspective view of the cardboard box used in the packing apparatus in FIG. 1 and shows the cardboard box in which the upper-lid-side flaps are folded in and closed by a box closing unit and the upper lid is sealed with a tape.
Figure 5:
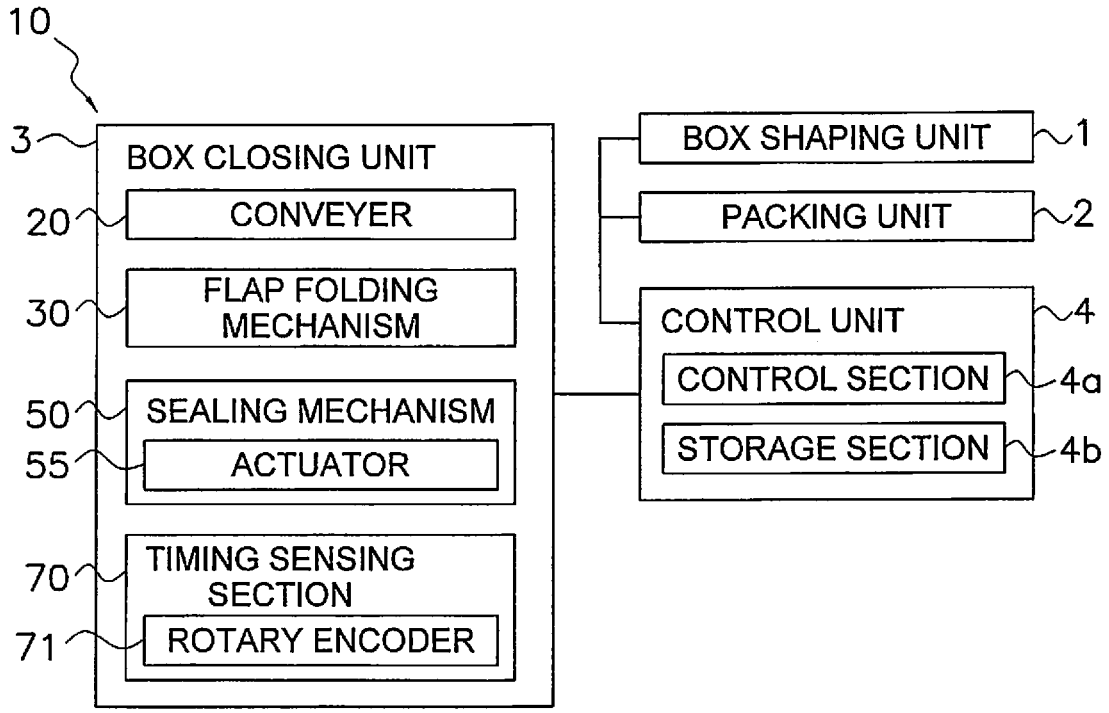
FIG. 5 is a block diagram of the packing apparatus in FIG. 1.

The packing apparatus 10 primarily includes a box shaping unit 1, a packing unit 2, a box closing unit 3, and a control unit 4 (see FIGS. 1 and 5).

The box shaping unit 1 shapes a cardboard box C, in which only an upper lid U is opened. Specifically, the box shaping unit 1 opens a cardboard box sheet G (folded-up cardboard box C), folds and closes flaps on a bottom lid B side of the cardboard box C, and affixes a tape on the flaps to seal the bottom lid B of the cardboard box C. The cardboard box C, which has been shaped into a box by the box shaping unit 1, is transported to the packing unit 2 by a conveyer (not shown) in a state that an opening on the upper lid U side is laterally (rearwardly) oriented, in other words, in a state that the bottom lid B is laterally (frontwardly) oriented (see FIG. 1). In other word, the words transported, transporting and transport all refer to the movement of the cardboard box sheet G and the assembled cardboard box C as it moves or is transported through the various sections of the packing apparatus 10.

The packing unit 2 loads objects to be packed into the cardboard box C shaped by the box shaping unit 1 through the opening on the upper lid U side of the cardboard box C. Specifically, the packing unit 2 loads the objects to be packed from the horizontal direction (rearward direction) into the cardboard box C which is supplied by the box shaping unit 1 and places the opening rearward. After the objects to be packed are loaded, the packing unit 2 rotates the cardboard box C in such a way that the opening on the upper lid U side is oriented upward and places the cardboard box C in a predetermined position on a conveyer 20 in the box closing unit 3, which will be described later.

The box closing unit 3 folds in minor flaps E1, E2 and major flaps F1, F2 (see FIG. 2A) adjacent to the opening on the upper lid U side, and affixes a tape T on the flaps to seal the upper lid U of the cardboard box C (see FIG. 2B) while transporting, with the conveyer 20, the cardboard box C received from the packing unit 2 and having the opening on the upper lid U side oriented upward. The cardboard box C in which the upper lid U is sealed with the tape T is transported by the box closing unit 3 out of the packing apparatus 10.

The control unit 4 is electrically connected to the box shaping unit 1, the packing unit 2, and the box closing unit 3, as shown in FIG. 5, and controls the action of each of the box shaping unit 1, the packing unit 2, and the box closing unit 3.

(2) Detailed Configuration

The box closing unit 3 and the control unit 4 will be described below in detail.

(2-1) Box Closing Unit

Figure 3:
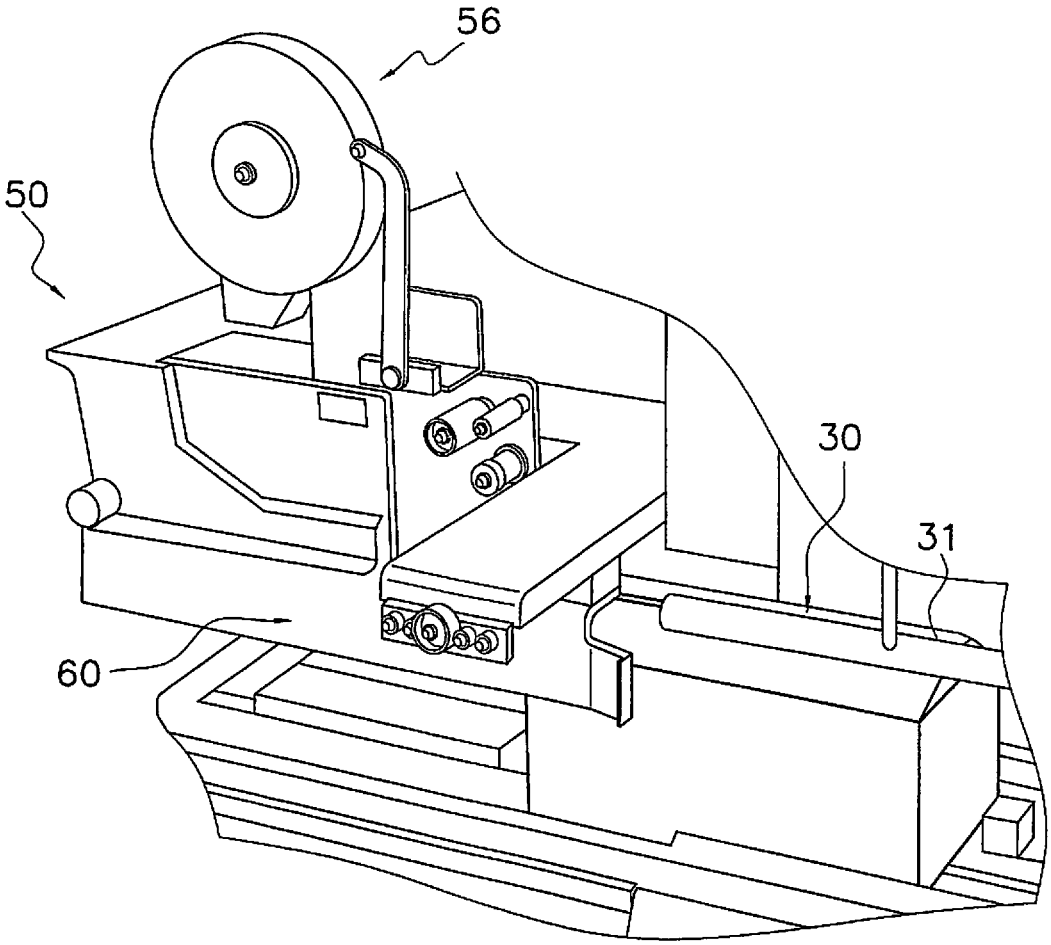
FIG. 3 is a perspective view of a sealing mechanism and therearound in the box closing unit of the packing apparatus in FIG. 1.
Figure 4:
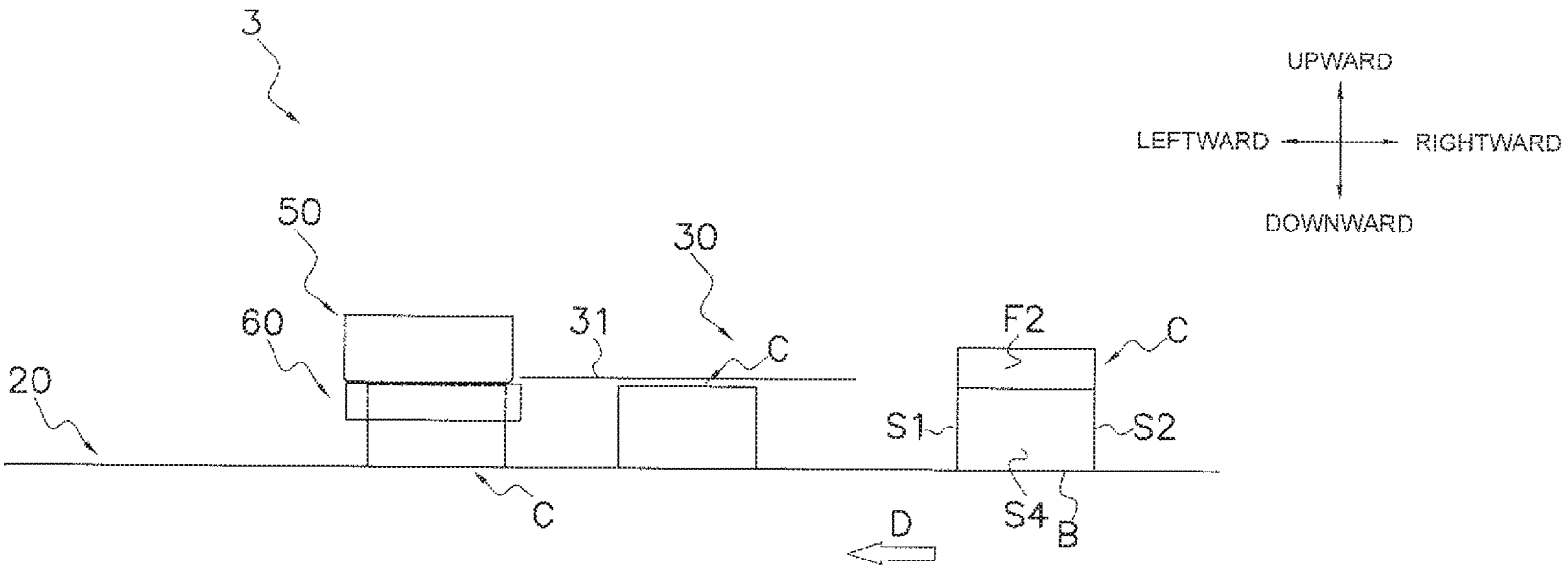
FIG. 4 is a schematic front view of the box closing unit of the packing apparatus in FIG. 1.

The box closing unit 3 primarily includes the conveyer 20, a flap folding mechanism 30, a sealing mechanism 50, a guide 60, and a timing sensing section 70 (see FIGS. 3 to 5).

(2-1-1) Conveyer

The conveyer 20 transports the cardboard box C received from the packing unit 2.

The cardboard box C that the conveyer 20 receives from the packing unit 2 has a rectangular shaped side surface section C1 constituted of four side surfaces (first side surface S1, second side surface S2, third side surface S3, and fourth side surface S4) and having a rectangular opening, as shown in FIG. 2A. The flaps that form the upper lid U and the bottom lid B respectively extend from opposite ends of the side surface section C1. Specifically, one flap is provided at each of opposite ends of each of the side surfaces S1, S2, S3, and S4, which constitutes the side surface section C1. At the point of time when the conveyer 20 receives the cardboard box C from the packing unit 2, the flaps on the bottom lid B side have been folded in and closed, and the bottom lid B is sealed with the tape. Meanwhile, the minor flaps E1, E2 and the major flaps F1, F2 on the upper lid U side, are open outward at the point of time when the conveyer 20 receives the cardboard box C from the packing unit 2 (see FIG. 2A). That is, at the point of time when the conveyer 20 receives the cardboard box C from the packing unit 2, the upper lid U side of the cardboard box C is open (see FIG. 2A). The minor flaps E1, E2 are flaps provided at the short edges of the rectangular opening of the side surface section C1. The major flaps F1, F2 are flaps provided at the long edges of the rectangular opening of the side surface section C1. The minor flap E1 extends continuously from the first surface S1. The minor flap E2 extends continuously from the second surface S2, which faces the first side surface S1. The major flap F1 extends continuously from the third surface S3. The major flap F2 extends continuously from the fourth surface S4, which faces the third side surface S3.

The cardboard box C with the bottom lid B facing downward and the upper lid U facing upward is placed in a predetermined position on the conveyer 20 by the packing unit 2 (see cardboard box C disposed in rightmost position in FIG. 4). The packing unit 2 places the cardboard box C with the first side surface S1 facing leftward, the second side surface S2 facing rightward, and the fourth side surface S4 facing frontward on the conveyer 20.

The conveyer 20 has a transportation surface extending in the rightward to leftward direction. The conveyer 20 transports the cardboard box C in a transportation direction D (leftward) (see FIG. 4). While being transported by the conveyer 20, the flap folding mechanism 30 folds in and closes the minor flaps E1, E2 and the major flaps F1, F2 (see FIG. 2A) of the cardboard box C, and the sealing mechanism 50 seals the upper lid U. The conveyer 20 transports the cardboard box C with the upper lid U sealed (see FIG. 2B) to a point outside the packing apparatus 10.

(2-1-2) Flap Folding Mechanism

The flap folding mechanism 30 folds in the minor flaps E1, E2 and the major flaps F1, F2 (see FIG. 2A) of the cardboard box C during the transportation by the conveyer 20. The flap folding mechanism 30 is disposed in a position upstream of the sealing mechanism 50 in the transportation direction D of the conveyer 20 (see FIG. 4).

The flap folding mechanism 30 folds in the minor flaps E1, E2 and the major flaps F1, F2 of the cardboard box C as follows:

The flap folding mechanism 30 first folds in the minor flaps E1, E2 with the aid of a member (not shown) in such a way that the opening on the upper lid U side of the cardboard box C is covered. The flap folding mechanism 30 then drives a rod-shaped member 31 (see FIG. 3), which extends along the transportation direction D of the conveyer 20, to push the major flaps F1, F2, fold in the major flaps F1, F2, and close the major flaps F1, F2 in such a way that the opening on the upper lid U side of the cardboard box C is covered. That is, the major flaps F1, F2 are folded in to overlap the minor flaps E1, E2, which in advance have been folded in, from above. In the state in which the major flaps F1, F2 are folded in and closed, a tip of the major flap F1 (far-side end relative to the third side surface S3, from which the major flap F1 extends) and a tip of the major flap F2 (far-side end relative to the fourth side surface S4, from which the major flap F2 extends) are positioned to be adjacent to each other (see FIG. 2B). The flap folding mechanism 30 folds in the minor flaps E1, E2 and the major flaps F1, F2 to close the opening on the upper lid U side of the cardboard box C.

The flap folding mechanism 30 causes the rod-shaped member 31 to be located above the major flaps F1, F2 of the cardboard box C being transported until the cardboard box C reaches the guide 60 (described later) and restricts movement of the major flaps F1, F2 in such a way that the folded-in minor flaps E1, E2 and major flaps F1, F2 do not unfold (see FIG. 3).

(2-1-3) Sealing Mechanism

The sealing mechanism 50 seals the upper lid U of the cardboard box C, which is transported by the conveyer 20 in a state that the major flaps F1, F2 are folded in and closed. Specifically, the sealing mechanism 50 affixes the tape T continuously on the following portions of the cardboard box C transported by the conveyer 20: the first side surface S1 on the downstream side with respect to the transportation direction D of the conveyer 20; the folded-in major flaps F1, F2; and the second side surface S2 which faces the first side surface S1 (second side surface S2 on the upstream side in the transportation direction D of the conveyer 20) to seal the upper lid U of the cardboard box C (see FIG. 2B). More specifically, the sealing mechanism 50 affixes the tape T continuously on an upper portion of the first side surface S1, a boundary portion between the folded-in major flap F1 and major flap F2, and an upper portion of the second side surface S2 of the cardboard box C transported by the conveyer 20 to seal the upper lid U of the cardboard box C (see FIG. 2B).

The sealing mechanism 50 will be described below with reference to FIGS. 3 and 6A to 6C. FIG. 3 is a schematic perspective view of the sealing mechanism 50. FIGS. 6A to 6C are schematic front views showing the interior of the sealing mechanism 50. FIG. 6A shows the sealing mechanism 50 before starting to affix the tape T on the cardboard box C. FIG. 6B shows the sealing mechanism 50 that is pressing the tape against the major flaps F1, F2 of the transported cardboard box C to affix the tape thereon. FIG. 6C shows the sealing mechanism 50 immediately after finishing the affixation of the tape T on the cardboard box C.

The sealing mechanism 50 primarily includes a first arm 51, a second arm 52, a link member 53, an elastic member 54, an actuator 55, and a tape roll 56, around which the tape T is wound (see FIGS. 3 and 6A).

The first arm 51 is an arm-shaped member configured to be swingable around a swing axis 51*a* extending in the frontward/rearward direction (see FIG. 6A). An affixing roller 51*b* is arranged at a tip of the first arm 51, which swings around the swing axis 51*a* (see FIG. 6A). The affixing roller 51*b* is an example of a pressing member. The affixing roller 51*b* is configured to press the tape T against the first side surface S1 and the major flaps F1, F2. The tape T of the tape roll 56 is configured to be guided to the affixing roller 51*b* (see FIG. 6A). When affixation of the tape T on the cardboard box C is initiated, an adhesive surface of the tape T having been guided from the tape roll 56 to the affixing roller 51*b*, is oriented toward the upstream side in the transportation direction D of the conveyer 20 (rightward). Further, when affixation of the tape T on the cardboard box C is initiated, a non-adhesive surface (surface opposite to the adhesive surface) of the tape T having been guided to the affixing roller 51*b* is supported by the affixing roller 51*b* from the downstream side in the transportation direction D of the conveyer 20 (leftward).

The second arm 52 is an arm-shaped member configured to be swingable around a swing axis 52*a* extending in the frontward/rearward direction (see FIG. 6A). The second arm 52 includes a first section 521 which extends downward with respect to the swing axis 52*a* and a second section 522 which extends upward with respect to the swing axis 52*a* (the second section 522 extending in a direction roughly opposite from the first section 521 with respect to the swing axis 52*a*), in the state before affixation of the tape T on the cardboard box C is initiated (state shown in FIG. 6A). A pressing roller 52*b* is arranged at an end of the first section 521 (see FIG. 6A). The pressing roller 52*b* is configured to press the tape T against the major flaps F1, F2 and the second side surface S2.

The link member 53 is a member to link the first arm 51 and the second arm to each other. Specifically, the link member 53, which has a rod shape, mutually links a portion of the first arm 51 in the vicinity of the swing axis 51*a*, and a portion of the second section 522 of the second arm 52 in the vicinity of the swing axis 52*a*. By linking the first arm 51 and the second arm 52 with the link member 53, the first arm 51 and the second arm 52 swing simultaneously with each other. Specifically, the first arm 51 and the second arm 52 swing in opposite directions.

More specifically, when the cardboard box C transported by the conveyer 20 comes into contact with the first arm 51 in the state shown in FIG. 6A from the upstream side in the transportation direction D of the conveyer 20 (from the right side), the first arm 51 swings clockwise around the swing axis 51*a* when viewed from the front and moves the affixing roller 51*b* upward (see FIG. 6B). At this point, the second arm 52, which is linked to the first arm 51 via the link member 53, receives force that presses the second section 522 leftward. As a result, the second arm 52 swings counterclockwise around the swing axis 52*a* when viewed from the front and moves the pressing roller 52*b* upward (see FIG. 6B).

When the cardboard box C is transported by the conveyer 20 and the pressing roller 52*b*, which has been pressing the major flaps F1, F2 of the cardboard box C downward as shown in FIG. 6B (in other words, the pressing roller 52*b*, which has been pressed upward by the major flaps F1, F2 of the cardboard box C), comes not in contact with the major flap F1, F2 anymore, the second arm 52 swings clockwise around the swing axis 52*a* when viewed from the front and moves the pressing roller 52*b* downward (see FIG. 6C). At this point, the first arm 51, which is linked to the second arm 52 via the link member 53, receives rightward pressing force. As a result, the first arm 51 swings counterclockwise around the swing axis 51*a* when viewed from the front and moves the affixing roller 51*b* downward (see FIG. 6C).

The elastic member 54 has one end fixed to a frame portion (stationary portion) of the sealing mechanism 50 and the other end linked to the second section 522 of the second arm 52. The elastic member 54 is, for example, a spring, but such an arrangement is not provided by way of limitation. The elastic member 54 is configured to exert force that pulls the second section 522 of the second arm 52 rightward due to the elastic force. When the force that pulls the second section 522 of the second arm 52 rightward acts, the second arm 52 is urged so as to swing clockwise around the swing axis 52*a* when viewed from the front. In other words, the pressing roller 52*b* is urged downward by the elastic member 54. When the second arm 52 is urged so as to swing clockwise around the swing axis 52*a* when viewed from the front with the elastic force exerted by the elastic member 54, the pressing roller 52*b* produces pressing force to press the tape T against the major flaps F1, F2 and the second side surface S2 of the transported cardboard box C.

Further, since the first arm 51 and the second arm 52 are linked to each other by the link member 53 as described above, the first arm 51 is urged so as to swing counterclockwise around the swing axis 51*a* when viewed from the front with the elastic force exerted by the elastic member 54. In other words, the affixing roller 51*b* is urged downward by the elastic member 54. When the first arm 51 is urged so as to swing counterclockwise around the swing axis 51*a* when viewed from the front with the elastic force exerted by the elastic member 54, the affixing roller 51*b* produces pressing force that presses the tape T against the first side surface S1 and the major flaps F1, F2 of the transported cardboard box C. In other words, the elastic member 54 causes the affixing roller 51*b* to produce the pressing force by exerting the elastic force on the affixing roller 51*b* via the second arm 52, the link member 53, and the first arm 51.

The second section 522 of the second arm 52 is further linked to the actuator 55. The actuator is, for example, an air cylinder, but no limitation is provided thereby. The action of the actuator 55 is controlled by a control section 4*a* of the control unit 4, which is described below. When the actuator 55 is actuated by the control section 4*a*, the actuator 55 pushes the second section 522 of the second arm 52 leftward. That is, when the actuator 55 is caused to operate, the second section 522 of the second arm 52 receives force in the direction opposite the direction in which the elastic member 54 exerts the elastic force on the second section 522. Therefore, when the actuator 55 is caused to operate, the force that urges the second arm 52 in such a way that the second arm 52 swings clockwise around the swing axis 52*a* when viewed from the front is reduced. In other words, when the actuator 55 is caused to operate, the force with which the elastic member 54 urges the pressing roller 52*b* downward is reduced. That is, when the actuator 55 is caused to operate, the pressing force with which the pressing roller 52*b* presses the tape T against the major flaps F1, F2 and the second side surface S2 of the transported cardboard box C is reduced. Further, since the first arm 51 and the second arm 52 are linked with each other by the link member 53 as described above, the pressing force which is produced at the affixing roller 51*b* due to the elastic force being applied by the elastic member 54 and is used for pressing the tape T against the first side surface S1 and the major flaps F1, F2 of the transported cardboard box C is reduced through the actuator 55 being caused to operate. That is, the actuator 55 acts on the affixing roller 51*b* via the second arm 52, the link member 53, and the first arm 51 in such a way that the pressing force exerted by the affixing roller 51*b* is reduced.

(2-1-4) Guide

The guide 60 (see FIG. 3) prevents deformation of the cardboard box C when the sealing mechanism 50 affixes the tape T on the cardboard box C.

The guide 60 includes a first guide member 61, which is arranged in a position behind the cardboard box C transported by the conveyer 20, and a second guide member 62, which is arranged in a position ahead of the cardboard box C transported by the conveyer 20.

Each of the first guide member 61 and the second guide member 62 is a member formed in an L-like shape in a right side view (see FIG. 7).

The first guide member 61 comes into contact with an upper portion of the third side surface S3 (side surface adjacent to the first side surface S1) of the cardboard box C and the major flap F1 when the sealing mechanism 50 affixes the tape T. The first guide member 61 comes into contact with the corner-shaped boundary between the third side surface S3 and the major flap F1 of the cardboard box C when the sealing mechanism 50 affixes the tape T.

The second guide member 62 comes into contact with an upper portion of the fourth side surface S4 (side surface adjacent to the first side surface S1) and the major flap F2 of the cardboard box C when the sealing mechanism 50 affixes the tape T. The second guide member 62 comes into contact with the corner-shaped boundary between the fourth side surface S4 and the major flap F2 of the cardboard box C when the sealing mechanism 50 affixes the tape T.

The first guide member 61 and the second guide member 62 extend from a position located on the upstream side in the transportation direction D of the conveyer 20 with respect to the position of the affixing roller 51*b* (see FIG. 6A) of the sealing mechanism 50 before affixation of the tape T on the cardboard box C is initiated, to a position located in the vicinity of the downstream end of the sealing mechanism 50 in the transportation direction D of the conveyer 20. The guide 60 comes into contact with the third side surface S3, the fourth side surface S4, and the major flaps F1, F2 at least in the vicinities of the portions pushed by the affixing roller 51*b* and the pressing roller 52*b* when the sealing mechanism 50 affixes the tape T on the cardboard box C.

Providing this type of guide 60 can suppress deformation of the cardboard box C even in a case where the cardboard box C is likely to be deformed. In a specific description, providing the guide 60 can suppress deformation of the cardboard box C from the following reason:

When the affixing roller 51*b* presses a central portion of the first side surface S1 of the cardboard box C in the rightward direction, the pressed portion of the first side surface S1 tends deform concavely toward the interior of the cardboard box C. On the other hand, the third side surface S3 and the fourth side surface S4, which are adjacent to the first side surface S1, and the major flaps F1, F2, receive force that attempts to cause the cardboard box C to swell outward.

When the affixing roller 51*b* and the pressing roller 52*b* press the major flaps F1, F2 of the cardboard box C, the pressed portions of the major flaps F1, F2 tend to deform concavely toward the interior of the cardboard box C. On the other hand, the third side surface S3 and the fourth side surface S4, which extend from the major flaps F1, F2, receive force that attempts to cause the cardboard box C to swell outward.

In view of the situations described above, providing the guide 60 and supporting the third side surface S3, the fourth side surface S4, and the major flaps F1, F2 so as not to deform (so as to restrict deformation in such a way that the cardboard box C does not swell outward) can suppress deformation of the cardboard box C that occurs when the first side surface S1 and the major flaps F1, F2 are pushed.

(2-1-5) Timing Sensing Section

The timing sensing section 70 (see FIG. 5) senses the timing at which the affixing of the tape T on the first side surface S1 is initiated. The timing sensing section 70 (see FIG. 5) includes a rotary encoder 71, which is provided to the swing axis 51*a* of the first arm 51 of the sealing mechanism 50.

The rotary encoder 71 senses the swing motion of the first arm 51 when the first side surface S1 of the cardboard box C comes into contact with the affixing roller 51*b* and the first arm 51 swings around the swing axis 51*a*. In other words, the rotary encoder 71 detects that the cardboard box C comes into contact with the affixing roller 51*b*. That is, the rotary encoder 71 detects that the cardboard box C presses the affixing roller 51*b*. It is noted that the expression stating that the cardboard box C comes into contact with the affixing roller 51*b* includes not only the case where the cardboard box C comes into direct contact with the affixing roller 51*b* but also a case where the cardboard box C comes into indirect contact with the affixing roller 51*b* via the tape T.

A result of the sensing performed by the timing sensing section 70 is transmitted to the control unit 4, which will be described later.

(2-2) Control Unit

The control unit 4 (also referred to as a controller) is electrically connected to the box shaping unit 1, the packing unit 2, and the box closing unit 3, as shown in FIG. 5, and controls the action of each of the box shaping unit 1, the packing unit 2, and the box closing unit 3. Also, the control unit 4 is configured to receive signals from a variety of sensors of the packing apparatus 10 including the timing sensing section 70.

The control unit 4 (the controller) includes the control section 4*a*, which primarily has a CPU (central processing unit), and a storage section 4*b*, which includes a ROM (read only memory), a RAM (random access memory), an HDD (hard disk drive), and other components.

The control section 4*a* calls and executes a variety of programs stored in the storage section 4*b* to control the action of each of the box shaping unit 1 and the packing unit 2. The control section 4*a* further controls the action of each of the portions of the box closing unit 3, such as the conveyer 20, the flap folding mechanism 30, and the sealing mechanism 50 in the box closing unit 3. The control section 4*a* is an example of a pressing force control section. The control section 4*a* controls the pressing force exerted by the affixing roller 51*b*, based on a result of the sensing performed by the timing sensing section 70, in such a way that the pressing force is reduced after the affixing of the tape T on the first side surface S1 is initiated. A specific example of the control will be described later.

(3) Action Performed by the Packing Apparatus when the Upper Lid of the Cardboard Box is Sealed The action performed by the packing apparatus 10 when the upper lid U of the cardboard box C is sealed will be described below.

First, the arrangement of the first arm 51 and the second arm 52 and the action state of the actuator 55 before affixation of the tape T on the cardboard box C is initiated will be described.

Before affixation of the tape T on the cardboard box C is initiated, the first arm 51 and the second arm 52 of the sealing mechanism 50 are arranged so as to jut into the path along which the cardboard box C is transported, as shown in FIG. 6A. That is, the first arm 51 is located so that the affixing roller 51*b* arranged at the tip of the first arm 51 comes into contact with the first side surface S1 of the transported cardboard box C. The second arm 52 is arranged so that the pressing roller 52*b* arranged at the tip of the first section 521 is positioned below the major flaps F1, F2 of the transported cardboard box C. Before affixation of the tape T on the cardboard box C is initiated, the control section 4*a* does not activate the actuator 55. That is, before affixation of the tape T on the cardboard box C is initiated, the actuator 55 does not exert a force on the second arm 52.

A description will next be made of how the upper lid U of the cardboard box C transported by the conveyer 20 is sealed.

First, when the cardboard box C in which the major flaps F1, F2 are closed is transported by the conveyer 20, the third side surface S3, the fourth side surface S4, and the major flaps F1, F2 of the cardboard box C start coming into contact with the guide 60.

When the cardboard box C is further transported by the conveyer 20, the affixing roller 51*b* at the tip of the first arm 51 comes into contact with the first side surface S1 of the cardboard box C via the tape T. In other words, the affixing roller 51*b* is pushed by the transported cardboard box C. At this point, the affixing roller 51*b* presses the adhesive surface of the tape T being placed at the upstream side in the transportation direction D, against the first side surface S1. The pressing force with which the affixing roller 51*b* presses the tape T against the first side surface S1 is produced because the elastic member 54 urges the affixing roller 51*b* downward with the elastic force (the elastic member 54 urges the first arm 51 in such a way that the first arm 51 swings counterclockwise around the swing axis 51*a* when viewed from the front). The affixing roller 51*b* presses the tape T against the first side surface S1, and the tape T is thereby affixed on the first side surface S1.

As described above, when the first side surface S1 of the cardboard box C comes into contact with the affixing roller 51*b* (more specifically, when the first side surface S1 of the cardboard box C comes into contact with the affixing roller 51*b* via the tape T), the affixing roller 51*b* is pressed leftward, and the first arm 51 swings clockwise around the swing axis 51*a*. The timing sensing section 70 senses the swing motion of the first arm 51 (senses that cardboard box C comes into contact with affixing roller 51*b*) with the rotary encoder 71 provided to the swing axis 51*a* and transmits a result of the sensing to the control section 4*a* of the control unit 4.

The control section 4*a* causes the actuator 55 to operate based on the result of the sensing performed by the timing sensing section 70. More specifically, when the control section 4*a* receives, from the timing sensing section 70, a signal informing that the first side surface S1 of the cardboard box C comes into contact with the affixing roller 51*b* via the tape T (that the first side surface S1 of the cardboard box C presses the affixing roller 51*b* via the tape T), the control section 4*a* causes the actuator 55 to operate. The actuator 55 pushes the second section 522 of the second arm 52 leftward (in the direction opposite the direction of the elastic force that the elastic member 54 exerts on the second section 522). As a result, the pressing force that the elastic member 54 causes the affixing roller 51*b* to produce and that is exerted on the first side surface S1 and the major flaps F1, F2 is reduced, as described above.

As a result of weakening the pressing force exerted by the affixing roller 51*b* on the first side surface S1 and the major flaps F1, F2, the first arm 51 is allowed to swing with relatively small force clockwise around the swing axis 51*a* when viewed from the front. The affixing roller 51*b* is therefore moved with relatively small force (force smaller than in a case where no actuator 55 is provided) to the position shown in FIG. 6B when affixing roller 51*b* is pushed by the first side surface S1 and the major flaps F1, F2 of the cardboard box C. In other words, the affixing roller 51*b* moves to the position shown in FIG. 6B while only exerting smaller force on the first side surface S1 and the major flaps F1, F2 of the cardboard box C than in a case where the actuator 55 does not operate. The affixing roller 51*b* and the pressing roller 52*b* then press the tape T against the major flaps F1, F2 with relatively small force (force smaller than in a case where the actuator 55 is not provided).

The tape T supplied from the tape roll 56 is cut by a mechanism (not shown) at a predetermined timing after affixation of the tape T on the major flaps F1, F2 is initiated. The tape T will be cut by an appropriate-length with which the tape T can be continuously affixed on the upper portion of the first side surface S1, the major flaps F1, F2, and the upper portion of the second side surface S2.

When the cardboard box C is further transported in the transportation direction D of the conveyer 20, the pressing roller 52*b* ceases to be in contact with the major flap F1 or F2 via the tape T. In this state, the elastic force exerted by the elastic member 54 causes the second arm 52 to swing clockwise around the swing axis 52*a* when viewed from the front and the pressing roller 52*b* presses the tape T against the second side surface S2 to affix the tape T on the second side surface S2 (see FIG. 6C).

(4) Features (4-1)

The packing apparatus 10 according to the present embodiment includes the sealing mechanism 50, the timing sensing section 70, and the control section 4*a* as an example of the pressing force control section. The sealing mechanism 50 affixes the tape T continuously on the following portions of the cardboard box C transported in the state that the major flaps F1, F2 are folded in and closed: the first side surface S1 on the downstream side with respect to the transportation direction D; the folded-in major flaps F1, F2; and the second side surface S2 facing the first side surface S1, to seal the upper lid U of the cardboard box C. The sealing mechanism 50 includes the affixing roller 51*b* as an example of the pressing member to press the tape T against the first side surface S1 and the major flaps F1, F2. The timing sensing section 70 senses the timing at which affixation of the tape T on the first side surface S1 is initiated. The control section 4*a* controls the pressing force exerted by the affixing roller 51*b*, based on a result of the sensing performed by the timing sensing section 70, in such a way that the pressing force is reduced after the affixing of the tape T on the first side surface S1 is initiated.

In the embodiment, after the affixing of the tape T on the first side surface S1 is initiated, the pressing force exerted by the affixing roller 51*b*, which presses the tape T against the first side surface S1 and the major flaps F1, F2, is controlled to be reduced in the sealing mechanism 50. The packing apparatus 10 can therefore suppress the incidence of sealing errors, in which the tape T fails to be affixed on the first side surface S1 of the cardboard box C, and can prevent deformation of the cardboard box C or any other problem therewith due to the pressing force.

(4-2)

In the packing apparatus 10 according to the present embodiment, the sealing mechanism 50 includes the elastic member 54 and the actuator 55. The elastic member 54 exerts elastic force on the affixing roller 51*b* to cause the affixing roller 51*b* to produce pressing force. The actuator 55 acts on the affixing roller 51*b* in such a way that the pressing force exerted by the affixing roller 51*b* is reduced. The control section 4*a* controls the pressing force of the affixing roller 51*b*, which the elastic member 54 causes to produce, to be reduced by operating the actuator 55.

In this embodiment, the incidence of sealing errors, in which the tape T fails to be affixed on the first side surface S1, can be reduced, and deformation of the cardboard box C or any other problem therewith due to the pressing force can be avoided by using a relatively simple configuration.

(4-3)

In the packing apparatus 10 according to the present embodiment, the timing sensing section 70 includes the rotary encoder 71, which detects that the cardboard box C comes into contact with the affixing roller 51*b*. The rotary encoder 71 is an example of a sensor to detect that the cardboard box C comes into contact with the affixing roller 51*b*. The state in which the cardboard box C comes into contact with the affixing roller 51*b* includes the state in which the cardboard box C comes into contact with the affixing roller 51*b* via the tape T.

Since the timing, at which affixation of the tape T on the first side surface S1 is initiated, is sensed by detecting that the cardboard box C comes into contact with the affixing roller 51*b*, it is easy for the timing at which affixation of the tape T is initiated to be accurately ascertained.

(4-4)

The packing apparatus 10 according to the present embodiment includes the guide 60. The guide 60 comes into contact with the major flaps F1, F2 and the third side surface S3 and the fourth side surface S4 of the cardboard box C which are adjacent to the first side surface S1 when the sealing mechanism 50 affixes the tape T.

Since the guide 60, which comes into contact with the major flaps F1, F2 and the third side surface S3 and the fourth side surface S4 which are adjacent to the first side surface S1, is provided, deformation of the cardboard box C can be readily avoided when the affixing roller 51*b* exerts the pressing force on the first side surface S1 and the major flaps F1, F2.

(5) Modifications

Modifications of the present embodiment will be shown below. A plurality of the modifications may be combined with each other as appropriate to the extent that they do not contradict each other.

(5-1) Modification A

In the packing apparatus 10 according to the embodiment described above, the sealing mechanism 50 includes the elastic member 54 and the actuator 55, and the timing sensing section 70 includes the rotary encoder 71. The configuration described above is an example and is not provided by way of limitation.

Figure 8:
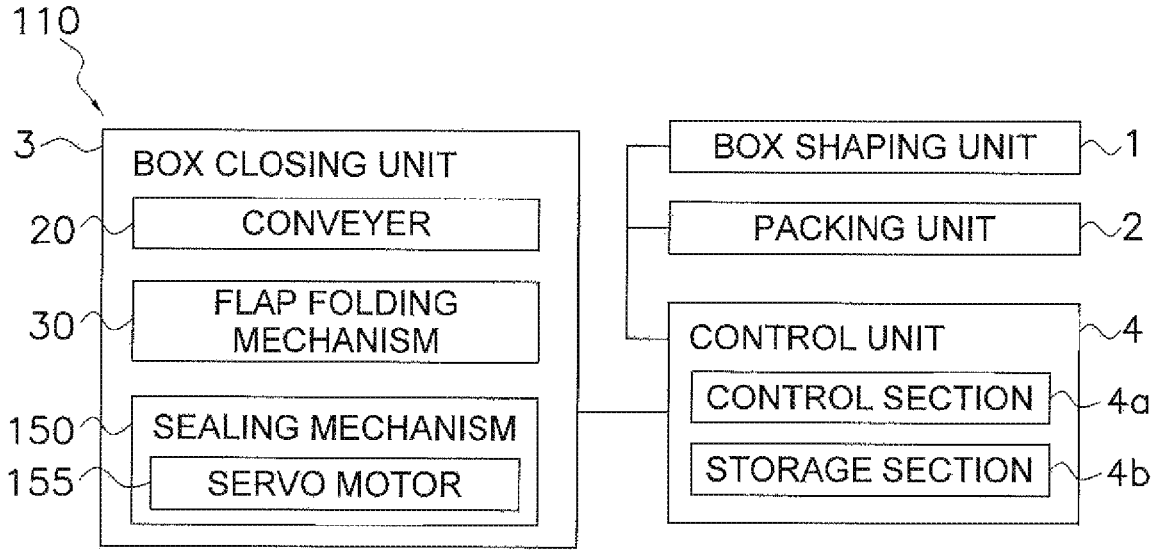
FIG. 8 is a block diagram of the packing apparatus according to Variation A.

For example, in a packing apparatus 110 according to Modification A, a sealing mechanism 150 may include a servo motor 155 (see FIG. 8), which is linked to the second section 522 of the second arm 52, in place of the elastic member 54 and the actuator 55. Further, the packing apparatus 110 may not include the timing sensing section 70, which includes the rotary encoder 71. The servo motor 155 is preferably configured to cause the affixing roller 51*b* of the sealing mechanism 150 to produce the pressing force that presses the tape T against the first side surface S1 and the major flaps F1, F2. The servo motor 155 is preferably configured to detect that the first side surface S1 of the cardboard box C comes into contact with the affixing roller 51*b* (via the tape T). The control section 4*a* preferably controls the action of the servo motor 155 based on a result of the detection performed by the servo motor 155 as the timing sensing section in such a way that the pressing force exerted by the affixing roller 51*b* is reduced after affixation of the tape T on the first side surface S1 is initiated.

(5-2) Modification B

In the embodiment described above, the timing sensing section 70 includes the rotary encoder 71, which detects that the cardboard box C comes into contact with the affixing roller 51*b*, but such an arrangement is not provided by way of limitation.

Figure 9:
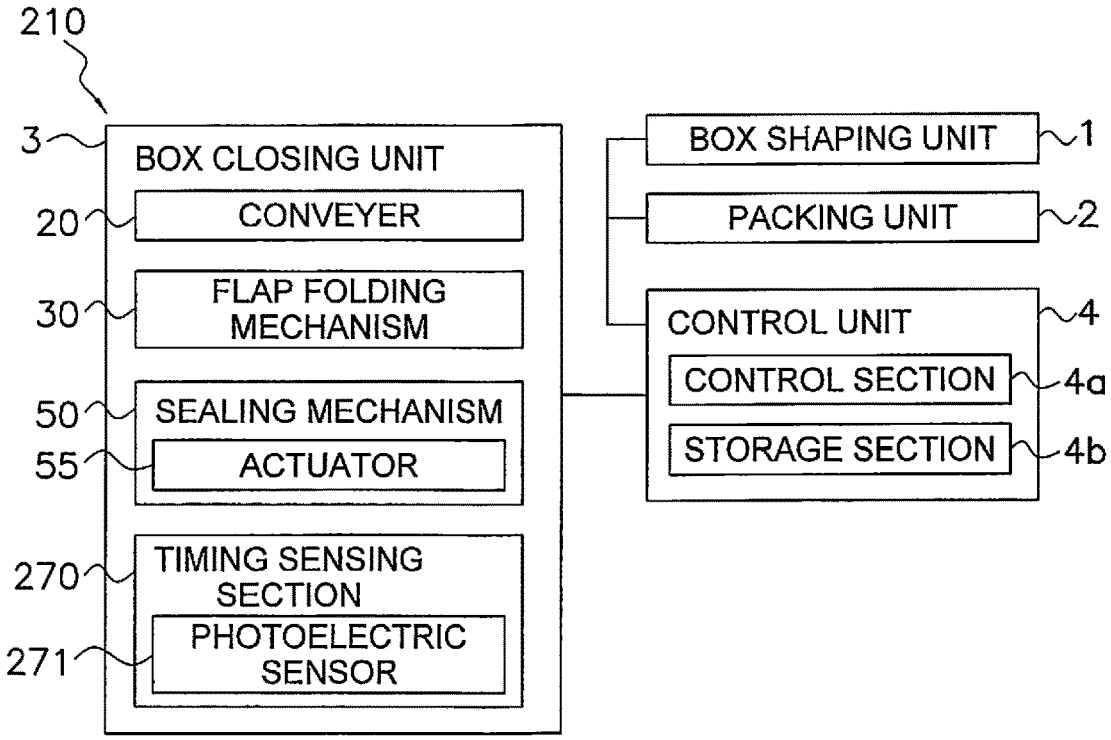
FIG. 9 is a block diagram of the packing apparatus according to Variation B.

For example, in a packing apparatus 210 in FIG. 9, a timing sensing section 270 may include a photoelectric sensor 271, which senses whether or not the transported cardboard box C is present. For example, disposing the photoelectric sensor 271 at a position on the upstream side in the transportation direction D of the conveyer 20 relative to the position of the affixing roller 51*b* of the sealing mechanism 50 before affixation of the tape T is initiated (see FIG. 6A) and close to the affixing roller 51*b*, allows the timing at which affixation of the tape T on the first side surface S1 is initiated to be readily sensed.

In this modification, a relatively simple configuration using the photoelectric sensor 271 allows sensing of the timing at which affixation of the tape T on the first side surface S1 is initiated.

(5-3) Modification C

In the embodiment described above, the timing sensing section 70 includes the rotary encoder 71, which detects that the cardboard box C comes into contact with the affixing roller 51*b*, but such an arrangement is not provided by way of limitation.

Figure 10:
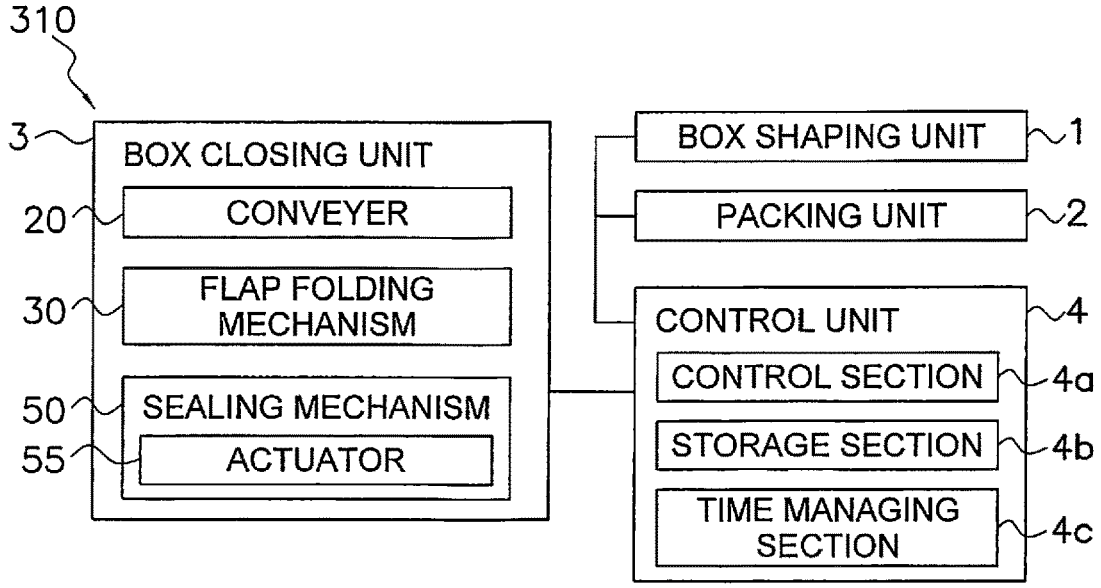
FIG. 10 is a block diagram of the packing apparatus according to Variation C.

For example, in a packing apparatus 310 in FIG. 10, the control unit 4 may include a time managing section 4*c* as the timing sensing section in place of the timing sensing section 70 including the rotary encoder 71.

The packing unit 2 places the cardboard box C in a predetermined position (hereinafter referred to as initial position) on the conveyer 20. Therefore, when the transportation speed of the conveyer 20 and the distance from the initial position to the position of the affixing roller 51*b* before affixation of the tape T is initiated (see FIG. 6A) are known, the time managing section 4*c* can sense the timing at which affixation of the tape T on the first side surface S1 is initiated based on the time for which the conveyer 20 is transported from the initial position.

In this modification, the timing at which affixation of the tape T on the first side surface S1 is initiated can therefore be sensed without additionally providing a sensor.

(5-4) Modification D

The above embodiment was described about a case where the box closing unit 3 seals the upper lid U, but such an arrangement is not provided by way of limitation. In place of the box closing unit 3 or in addition to the box closing unit 3, the similar configuration described above may be applied to the sealing of the bottom lid B performed by the box shaping unit 1.

When the configuration described above is applied to the sealing of the bottom lid B performed by the box shaping unit 1, sealing may be performed for the cardboard box C, which is in a state that the bottom lid B is laterally oriented. The sealing mechanism 50 may be disposed in an appropriate orientation accordingly.

(5-5) Modification E

The shape and structure of the sealing mechanism 50 according to the embodiment described above are presented by way of example and not by way of limitation; other shapes and structures having the same function may be employed. For example, the elastic member 54 may be linked to the first arm 51 instead of the second arm 52 so as to exert the elastic force to the first arm 51. Further, for example, the actuator 55 may be linked to the first arm 51 instead of the second arm 52 to act on the affixing roller 51*b* via the first arm 51 in such a way that the pressing force exerted by the affixing roller 51*b* is reduced.

(5-6) Modification F

In the embodiment described above, the control section 4*a* causes the actuator 55 to operate in such a way that the pressing force exerted by the affixing roller 51*b* and the pressing roller 52*b* on the cardboard box C is reduced and then keeps the actuator 55 operating until the affixation of the tape T on the cardboard box C is completed, but such an arrangement is not provided by way of limitation. For example, to make the pressing roller 52*b* more strongly press the tape T against the second side surface S2, the control section 4*a* may control the actuator 55 in such a way that the actuator 55 stops operating before the affixing of the tape T on the cardboard box C is completed.

(5-7) Modification G

In the embodiment described above, the direction in which the actuator 55 in operation exerts force on the second arm 52 is opposite to the direction in which the elastic member 54 exerts the elastic force on the second arm 52, and the pressing force that the elastic member 54 causes the affixing roller 51*b* to produce is reduced by operating the actuator 55, but such an arrangement is not provided by way of limitation.

For example, the direction in which the actuator 55 in operation exerts force on the second arm 52 may be the same as the direction in which the elastic member 54 exerts force on the second arm 52. In this case, it is preferable that the control section 4*a* causes the actuator 55 to operate before affixation of the tape T on the cardboard box C is initiated to increase the pressing force exerted by the affixing roller 51*b*, and when the control section 4*a* receives, from the timing sensing section 70, a signal to inform that the first side surface S1 of the cardboard box C comes into contact with the affixing roller 51*b* via the tape T, the control section 4*a* causes the actuator 55 to stop operating to weaken the pressing force exerted by the affixing roller 51*b*. In the configuration described above, the spring or any other component as the elastic member 54 is preferably selected so that when the elastic force produced by the spring or any other component is exerted on the second arm 52, the pressing force exerted by the affixing roller 51*b* does not deform or damage the cardboard box C.

INDUSTRIAL APPLICABILITY

The packing apparatus according to the invention is a packing apparatus having a sealing mechanism sealing a cardboard box being transported with a tape, that is unlikely to produce sealing errors, where the tape fails to be affixed on the cardboard box, and can prevent deformation of the cardboard box or any other problem therewith.

The invention claimed is:

1. A packing apparatus comprising:

a sealing mechanism configured to affix a tape continuously on portions of a cardboard box transported in a state that a flap thereof is folded in and closed forming a folded-in flap, including a first side surface of the cardboard box on a downstream side with respect to a transportation direction of the cardboard box through the packaging apparatus, the folded-in flap, and a second side surface facing the first side surface, and seal a lid of the cardboard box, the sealing mechanism further including a first pressing member and a second pressing member, the first pressing member being configured to press the tape against the first side surface and the flap, the second pressing member being configured to press the tape against the flap and the second side surface, the packing apparatus further comprising an electronic controller that includes:

a timing sensing section configured to detect a timing at which the affixing of the tape on the first side surface is initiated by the first pressing member, the first pressing member initially applying an initial pressing force affixing the tape to the cardboard box; and a pressing force control section configured to reduce the initial pressing force exerted by the first and second pressing members to a reduced pressing force that is less than the initial pressing force in response to the timing sensing section detecting that the affixing of the tape on the first side surface is initiated and continuing exerting the reduced pressing force at least until affixing of the tape to the flaps is completed.

2. The packing apparatus according to claim 1, wherein the sealing mechanism further includes an elastic member configured to exert elastic force on the first and second pressing members to cause the pressing member to produce the initial pressing force, and an actuator configured to act on the first and second pressing members and the elastic member in response to the timing sensing section detecting that the affixing of the tape on the first side surface is initiated reducing the initial pressing force to the reduced pressing force, wherein with the actuator being actuated, the actuator applies a counteracting force to the elastic member thereby counteracting a portion of the initial pressing force to establish the reduced pressing force.

3. The packing apparatus according to claim 1, wherein the timing sensing section includes a sensor configured to detect whether or not the cardboard box contacts the pressing member.

4. The packing apparatus according to claim 1, wherein the timing sensing section includes a photoelectric sensor configured to detect whether or not the transported cardboard box is present.

5. The packing apparatus according to claim 1, wherein the timing sensing section is configured to sense the timing at which the affixing of the tape on the first side surface is initiated based on a time for which the cardboard box is transported from a predetermined position.

6. The packing apparatus according to claim 1, further comprising a guide which comes into contact with the flap and a side surface of the cardboard box that is adjacent to the first side surface when the sealing mechanism affixes the tape.

7. The packing apparatus according to claim 2, wherein the timing sensing section includes a sensor configured to detect whether or not the cardboard box contacts the pressing member.

8. The packing apparatus according to claim 2, wherein the timing sensing section includes a photoelectric sensor configured to detect whether or not the transported cardboard box is present.

9. The packing apparatus according to claim 2, wherein the timing sensing section is configured to sense the timing at which the affixing of the tape on the first side surface is initiated based on a time for which the cardboard box is transported from a predetermined position.

10. The packing apparatus according to claim 2, further comprising a guide which comes into contact with the flap and a side surface of the cardboard box that is adjacent to the first side surface when the sealing mechanism affixes the tape.

* * * * *